United States Patent [19]

Antoni et al.

[11] Patent Number: 4,863,058

[45] Date of Patent: Sep. 5, 1989

[54] FOOD PACKAGING COVER

[75] Inventors: Patricia A. Antoni, Wheeling; Theodore R. Arneson, Mt. Prospect; Thomas J. Hayes, Wauconda; Timothy J. Nolan, Streamwood; Marilyn Stapleton, Wheeling, all of Ill.

[73] Assignee: Packaging Corporation of America, Evanston, Ill.

[21] Appl. No.: 162,420

[22] Filed: Mar. 1, 1988

[51] Int. Cl.[4] ..... B65D 43/10

[52] U.S. Cl. ..... 220/72; 220/355; 220/380; 215/321

[58] Field of Search ..... 220/72, 355, 380; 215/321, 328, 383, 337, 340

[56] References Cited

U.S. PATENT DOCUMENTS

| | | | |
|---|---|---|---|
| Re. 28,059 | 7/1974 | Mounts et al. . | |
| D. 290,232 | 6/1987 | Holzkopf | D9/424 |
| 1,331,543 | 2/1920 | Voshardt | 220/72 |
| 1,957,639 | 5/1934 | Goodwin | 220/72 |
| 2,246,695 | 6/1941 | Phillips | 206/45.32 |
| 3,216,148 | 11/1965 | Amberg | 215/321 |
| 3,303,964 | 2/1967 | Luker | 220/72 |
| 3,511,288 | 5/1970 | Swett et al. | 220/355 |
| 3,912,118 | 10/1975 | Bird | 220/306 |
| 4,421,244 | 12/1983 | Van Melle | 220/380 |

OTHER PUBLICATIONS

Ekco Products, Inc.-Advertising Brochure.

*Primary Examiner*—Stephen Marcus
*Assistant Examiner*—Christine A. Peterson
*Attorney, Agent, or Firm*—Neuman, Williams, Anderson & Olson

[57] ABSTRACT

The present invention relates to a food packaging cover for use with a compatible tray. The cover includes a top section, a wall section, a shoulder section interconnecting the top section and the wall section and a bottom peripheral edge formation designed to lockably engage the tray. The wall section is formed from a repeating pattern of furrows which enhance the strength of the cover. The interconnecting shoulder section is formed from triangular flats interspaced by gusset members to effect substantial uniform distribution to the wall section of a load placed on the top section.

26 Claims, 3 Drawing Sheets

FIG. 4
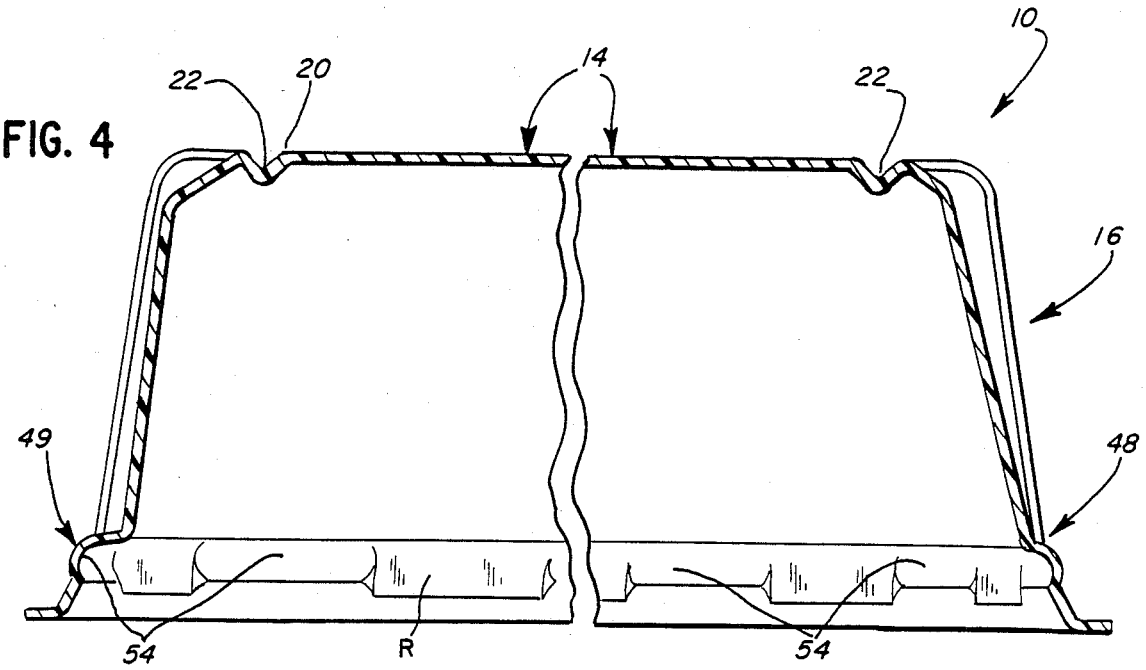
FIG. 5
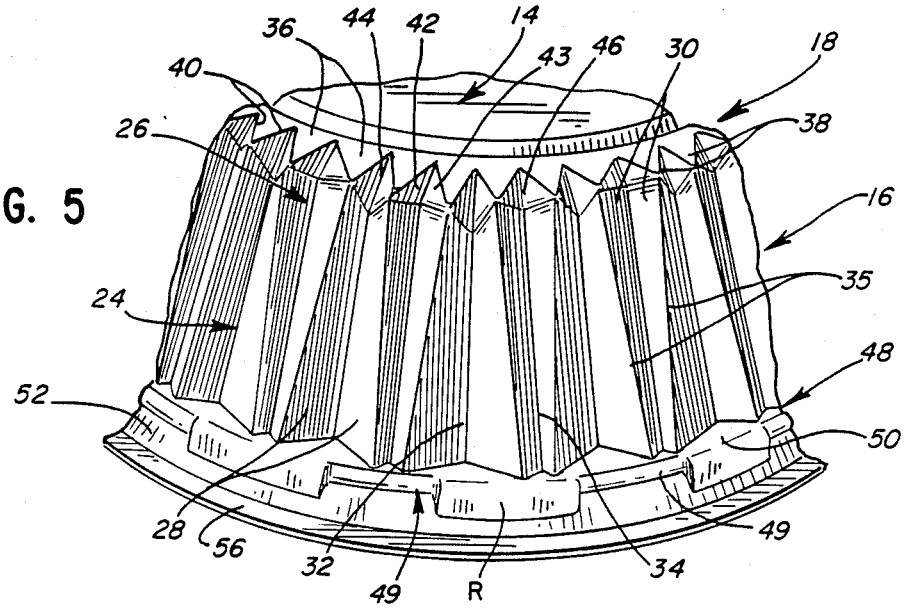
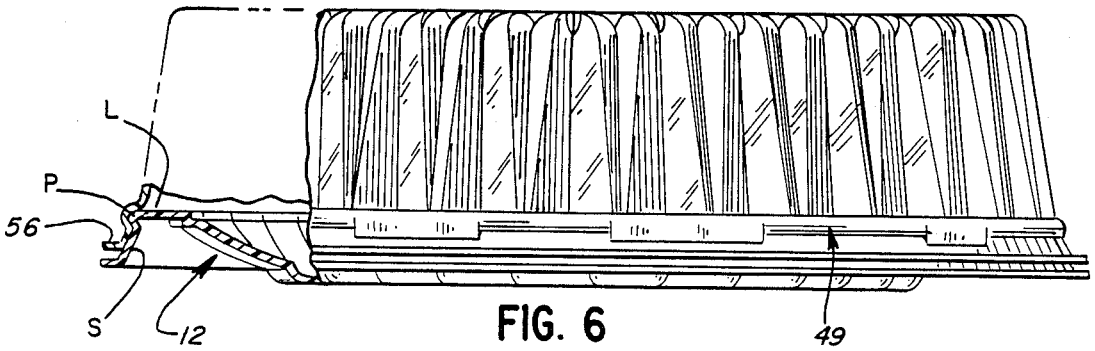
FIG. 6

FOOD PACKAGING COVER

BACKGROUND OF THE INVENTION

The use of inexpensive plastic or metallic serving trays with compatible plastic covers has become popular for dispensing and serving various food products including bakery goods and delicatessen products, the latter including coldcuts, cheeses, etc. Particularly, grocery stores, catering services and restaurants are utilizing these trays and covers in their businesses due to the attractiveness, light weight, stackability and disposability offered by these products. However, existing covers are not as strong as desired and do not provide the desired support and protection for the accommodated products. Specifically, the number of loaded trays with assembled covers which can be stacked on top of each other is limited. While storage space often allows for increased stacking, the covers buckle or fail if too many trays and covers are stacked on top of each other. This not only damages the cover, making the packaging unattractive to the consumer, but damages the accommodated food product as well. The food product then only can be sold at discounted prices resulting in decreased revenues and, perhaps, even pecuniary losses to the business owner.

SUMMARY OF THE INVENTION

Thus, it is an object of the invention to provide an improved food packaging cover for food trays which avoids the aforementioned shortcomings associated with the prior art.

It is a further object to provide a cover which is formed of thin gauge inexpensive plastic material and yet, is possessed of superior strength and stackability. Further and additional objects will appear from the description, accompanying drawings and appended claims.

In accordance with one embodiment of the invention, a food packaging cover of thin gauge plastic material is provided which is removably mountable on a cooperating tray. The cover includes a top section interconnected to a depending wall section by an intermediate shoulder section. The depending wall section is provided with symmetrically arranged substantially vertically extending flutes which form stiffening or strengthening ribs disposed between the flutes. The lower edge of the wall section terminates in an outwardly extending first flange and a second flange extending downwardly and outwardly from the outer periphery of the first flange. The juncture between the first and second flanges defines a plurality of circumferentially spaced annular pockets sized and shaped to lockingly engage a single annular lip or a plurality of symmetrically arranged lips formed on the periphery of a cooperating tray.

The cooperating tray will at least include a rim section having a marginal lip or lips for locking engagement with the annular pockets formed on the cover. Preferably, the rim section of the tray may include a ledge portion and a skirt portion depending from the outer periphery of the ledge portion. The skirt portion has an upper edge having segments thereof spaced from the underside of the ledge portion and recessed from the outer periphery thereof. The skirt portion upper edge segments coact with the ledge portion outer periphery to form a plurality of circumferentially spaced outwardly extending protuberances or lips lockingly engaged by the pockets formed on the cover when the cover and the tray are in assembled relation. In some cooperating trays, particularly those made of metal, the rim section is merely provided with a continuous peripheral bead which encompasses the tray. In such a tray, portions of the peripheral bead are lockingly accommodated by the pockets of the cover rim section.

DESCRIPTION OF THE DRAWINGS

For a more complete understanding of the invention, reference is made to the drawings wherein:

FIG. 4 is a fragmentary sectional view of the cover of FIG. 1 taken along line 4—4 of FIG. 1.

FIG. 5 is an enlarged fragmentary perspective top view of the cover of FIG. 1.

FIG. 6 is a side elevational view partially in vertical section of the cover of FIG. 1 in locking engagement with a cooperating tray.

DETAILED DESCRIPTION

Figure 1:
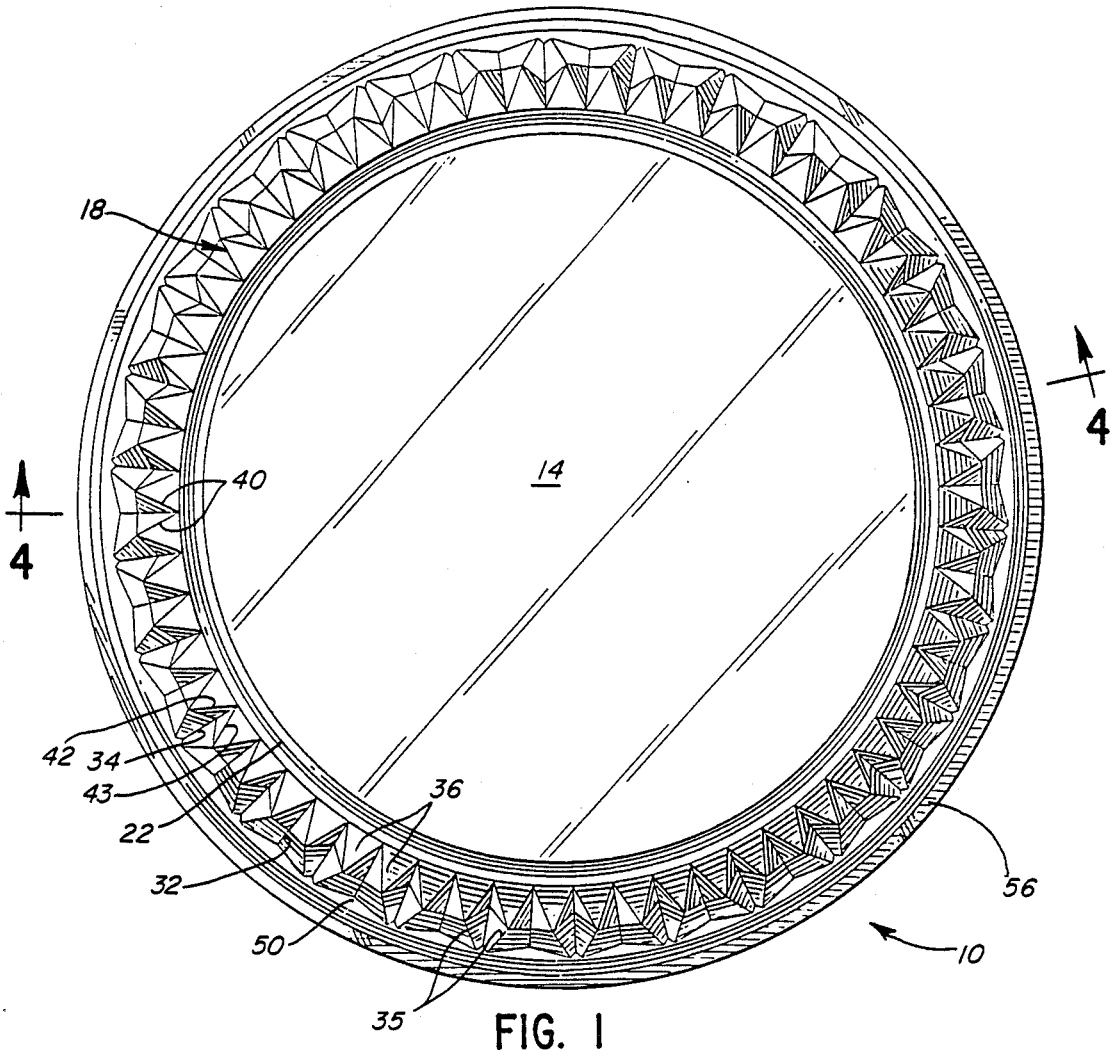
FIG. 1 is a top plan view of one embodiment of the improved food packaging cover.

Referring now to the drawings an improved food packaging lid or cover 10 is shown. The cover 10, is preferably formed of a thin gauge plastic material, i.e., clear oriented polystyrene, which is vacuum formed to the desired shape. FIG. 6 shows the cover 10 lockably engaging a cooperating tray 12, the latter may be formed of plastic, metal or wood. The cover is preferably transparent so that the customer can ascertain what the accommodated product is and the condition thereof without having to remove the cover. While the cover 10 as illustrated is of circular configuration, the invention herein disclosed is not intended to be limited thereto but may take various other geometric shapes such as square, rectangular, oval, triangular, etc.

The cover 10, as seen in FIG. 1, includes a top section 14, a depending wall section 16 and an intermediate or shoulder section 18, see FIG. 5, which interconnects the top section 14 and the depending wall section 16. The top section 14 is elevated with respect to the cooperating tray 12 to provide room for the accommodated product and is preferably planar. By way of enhancing the aesthetic appearance and marketing appeal of the cover, the top section 14 may be intaglioed to create a cut crystal effect.

In the preferred embodiment, shown best in FIGS. 4 and 5, the perimeter edge 20 of the top section 14 terminates in a downwardly directed or recessed groove or channel 22. In thin gauge plastic construction such as this, any embossing or distorting of flat or planar surfaces adds strength. Thus, the channel 22, while not contributing to the stack strength of the cover 10, does strengthen the top section 14 against distortion or possible failure such as buckling or creasing.

Figure 2:
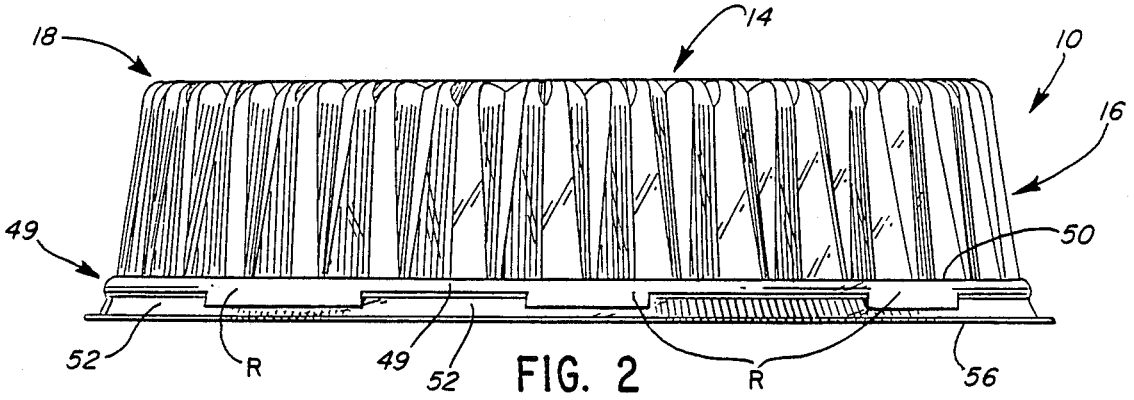
FIG. 2 is a side elevational view of the cover of FIG. 1.
Figure 3:
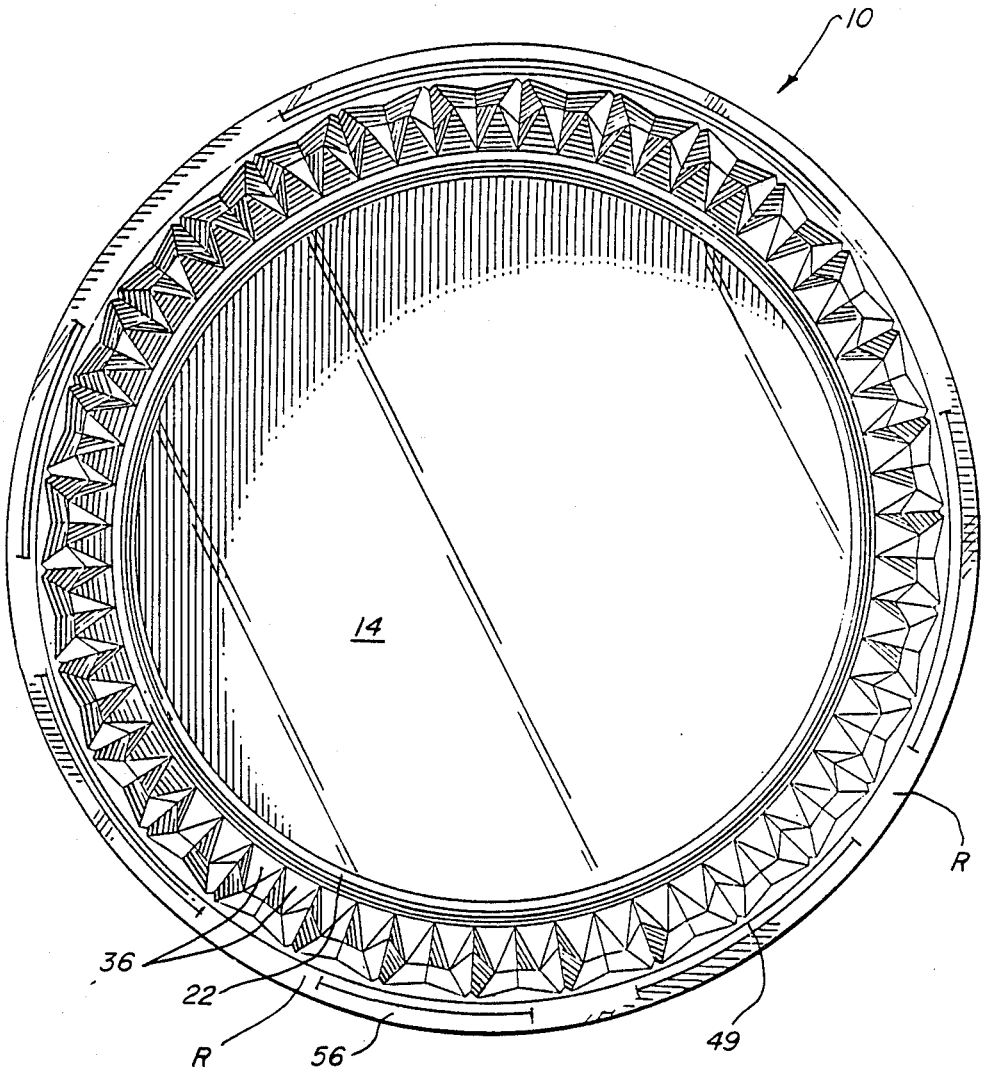
FIG. 3 is a bottom view of the cover of FIG. 1.

The top section 14 is delimited by the depending wall section 16. It is the unique shape of the wall section 16, in part, that provides the cover 10 with superior columnar or stack strength as compared to conventional thin gauge plastic covers. As can be seen in FIGS. 2 and 5, the wall section 16 of the preferred embodiment is formed from a pair of symmetrical, alternately repeating inwardly directed furrows 24 and 26 extending substantially the entire vertical height of the wall section 16. The furrows 24 and 26 are preferably triangular in cross section, having side walls 28 and 30 which converge to form an inwardly directed vertical ribs 32 and 34. The depth of each furrow 24 increases from one end to the other and the depth of the each furrow 26 increases in the opposite direction. In addition, each furrow 26 is narrower in cross section than each furrow 24.

The adjacent side walls 28 and 30 of adjacent furrows converge to form outwardly directed ribs 35 which separate adjacent furrows 24, 26. The adjacent outwardly directed ribs 35 are angularly disposed in spaced non-parallel relation with respect to the vertical axis defined by the inwardly directed furrows 24 and 26. Moreover, the outwardly directed ribs 35 are spaced farther apart at the deeper end of each furrow than at the opposite end.

The shoulder section 18, most clearly shown in FIG. 5, interconnects the top section 14 and the wall section 16. In the preferred embodiment, the shoulder section 18 is defined by symmetrically arranged triangular shaped flats 36. An exterior apex 38 of each triangular flat 36 merges into an outwardly directed rib 35 and the edges 40 of each flat 36 merge into gussets 42 and 43 which interconnect the adjacent furrow side walls 28 and 30 to the flats 36. The gussets 42 and 43 alternately separate each triangular flat 36 and converge to form inwardly directed ribs 44 and 46, respectively, which are continuations of ribs 32 and 34 formed at the base of each furrow. In addition to the increased columnar strength solely provided by the shape of the depending walls 16, the gussets 42, 43 act to more evenly disperse a load placed on the cover through the depending furrows 24, 26 thereby further increasing the overall strength of the cover.

While the ribs 32, 34 and 35 extend substantially the entire vertical height of the depending wall 16, the lower portion 48 of the depending wall 16 is provided with locking means 49, see FIG. 4, to releasably secure the cover 10 to a cooperating tray 12. In the preferred embodiment, the lower portion 48 terminates in an outwardly projecting first flange 50, which abuts a ledge portion L formed in the cooperating tray 12 when the cover 10 is locked to the tray 12, see FIG. 6. A second flange 52 extends downwardly and outwardly from the outer depending periphery of the first flange 50. The juncture between the first and second flanges defines a plurality of circumferentially spaced pockets 54, each of which is sized and shaped so as to lockingly accommodate a continuous bead or circumferentially spaced protuberances or lips P formed on the rim of the tray 12. Each protuberance P includes ledge portion L. The circumferential dimensions of the pockets and the spacing R between adjacent pockets is preferably non-uniform so that regardless of how the cover is aligned with respect to the tray, all or substantially all of the pockets will lockingly engage the lips formed on the periphery of the tray. By having a plurality of spaced pockets, rather than one continuous pocket, any slight distortion in the shape of a pocket due to manufacturing error which might adversely affect locking engagement between a continuous pocket and a tray is readily avoided by having a plurality of pockets. In the latter situation, an imperfection in one pocket will not adversely affect the locking engagement of the remaining pockets.

The lower edge 56 of the second flange 52 may be offset outwardly a small amount as shown in FIGS. 4 and 6. When the cover 10 is assembled on the tray 12, the pockets 54 and second flange 52 will snugly encompass, respectively, the protuberances P and a depending skirt portion S of the tray 12 and the first flange 50 will rest upon the ledge portions L of the tray protuberances P. Thus, the wall 16 of the cover 10 is supported by the tray ledge portions.

The height and shape of the cover and the shape and number of the ribs formed in the cover wall may also vary from that shown without departing from the scope of the invention. Furthermore, as aforementioned the tray may be of conventional design and formed of metal or wood and plastic. Rather than having two different furrows alternately repeating throughout the wall section, more furrows may be added to the pattern and the pattern can change. Also, the furrows can vary in vertical height being shorter or larger as desired or the furrows may be directed outwardly rather than inwardly.

We claim:

1. A food packaging cover comprising: an elevated top section, a depending wall section, a shoulder section interconnecting said top and wall sections, and a tray locking means disposed at the base of said wall section, said wall section being formed from first and second vertical furrows repeating in a predetermined pattern, said shoulder section formed from a plurality of outwardly projecting flats disposed along the perimeter of said top section and being planar with said top section, and further having gusset means disposed between adjacent flats, said gusset means interconnecting said flats and furrows to substantially uniformly distribute a load placed on said top section to said wall section.

2. The food packaging cover of claim 1 wherein each of said first furrows comprise a pair of inwardly converging side walls which terminate in a recessed first rib, each of said second furrows comprise a pair of inwardly converging side walls which terminate in a recessed second rib, and the adjacent side walls of each said first and second furrows converge outwardly to form a protruding third rib.

3. The food packaging cover of claim 2 wherein the depth of said first furrows increase from one end to the other and the depth of said second furrows increase in the opposite direction.

4. The food packaging cover of claim 3 wherein the third ribs adjacent a furrow being spaced farther apart at the deepest end of said furrow.

5. The food packaging cover of claim 1, 4 or 21 wherein said first and second furrows are alternately arranged in side by side relation.

6. The food packaging cover of claim 1, 4 or 21 wherein said top section is encompassed by a circumferential groove.

7. The food packaging cover of claim 2 wherein each of said gusset means comprises a pair of inwardly converging side walls forming an inwardly projecting fourth rib, the latter being in substantial endwise alignment with a rib of said vertical furrows.

8. The food packaging cover of claim 1 wherein said top section is provided with an intaglioed pattern.

9. A food packaging cover comprising an elevated top section, a depending wall section and a shoulder section interconnecting the top and wall sections, said wall section formed from dissimilar first and second alternately arranged vertical furrows having inwardly converging side walls joining to form upright recessed ribs, said shoulder section formed from a plurality of outwardly projecting flats disposed along the perimeter of said top section and having first and second inwardly converging gusset means alternately disposed between adjacent flats for interconnecting said furrows with said flats and for substantially uniformly distributing a load placed on said top section to said wall section.

10. The food packaging cover of claim 9 wherein the adjacent side walls of each said first and second furrows converge outwardly to form a projecting rib.

11. The food packaging cover of claim 9 wherein the depth of said first furrows increase from one end to the other and the depth of said second furrows increase in the opposite direction.

12. The food packaging cover of claim 10 wherein said projecting ribs are spaced farther apart at the deepest end of said furrows.

13. The food packaging cover of claim 9 wherein said top section is encompassed by a circumferential groove.

14. The food packaging cover of claim 9 wherein said top section is provided with an intaglioed pattern.

15. The food packaging cover of claim 9 wherein said first gusset means comprises a pair of inwardly converging side walls forming an inwardly projecting rib in substantial endwise alignment with said first furrow and said second gusset means comprises a pair of inwardly converging side walls forming an inwardly projecting rib in substantial endwise alignment with said second furrow.

16. A food packaging cover comprising an elevated top section, a depending wall section and a shoulder section interconnecting the top and wall sections, said wall section formed from first and second alternately repeating upright furrows, said first furrows increasing in depth from one end to the other and said second furrow increasing in depth in the opposite direction, said furrows having inwardly directed converging side walls joining to form recessed vertical ribs, the adjacent side walls of adjacent first and second furrows converging outwardly to form outwardly directed ribs.

17. The food packaging cover of claim 16 wherein said shoulder section includes a plurality of symmetrically arranged outwardly pointed triangular shaped flats disposed along the perimeter of said top section, and first and second gussets alternately disposed between adjacent flats, each first gusset having inwardly converging side walls forming an inwardly directed rib, said first gussets being aligned with upper portions of said first furrow side walls and interconnecting same with adjacent triangular flats, each second gusset having inwardly converging side walls forming an inwardly directed rib, said second gussets being aligned with the upper portions of said second furrow sidewalls and interconnecting same with adjacent flats.

18. The food packaging cover of claim 1 wherein the tray locking means includes an outwardly projecting, encompassing ledge portion, and a yieldable skirt portion extending downwardly and outwardly from said ledge portion; the junction between said ledge and skirt portions forming a plurality of circumferentially spaced pockets for lockingly accommodating peripheral portions of a tray.

19. The food packaging cover of claim 18 wherein the pockets having a non-uniform circumferential dimension.

20. The food packaging cover of claim 18 wherein the circumferential spacing between adjacent pockets is non-uniform.

21. A food packaging cover comprising: an elevated top section, a depending wall section, a shoulder section interconnecting said top and wall sections, and a tray locking means disposed at the base of said wall section, said wall section being formed from first and second vertical furrows repeating in a predetermined pattern, each of said first furrows comprising a pair of inwardly converging side walls which terminate in a recessed first rib, wherein the depth of said first furrows increase from one end to the other, each of said second furrows comprising a pair of inwardly converging side walls which terminate in a recessed second rib, wherein the depth of said second furrows increase in the opposite direction of said first furrow and the adjacent side walls of each said first and second furrows converge outwardly to form a protruding third rib.

22. The food packaging cover of claim 21 wherein the third ribs adjacent a furrow are spaced farther apart at the deepest end of said furrow.

23. A food packaging cover comprising an elevated top section, a depending wall section and a shoulder section interconnecting the top and wall sections, said wall section formed from first and second alternately arranged vertical furrows having inwardly converging side walls joining to form upright recessed ribs, said first furrow increasing in depth from one end to the other and said second furrow increasing in depth in the opposite direction, said shoulder section formed from a plurality of outwardly projecting flats disposed along the perimeter of said top section and having first and second inwardly converging gusset means alternately disposed between adjacent flats for interconnecting said furrows with said flats and for substantially uniformly distributing a load placed on said top section to said wall section.

24. The food packaging cover of claim 23 wherein said projecting ribs are spaced farther apart at the deepest end of said furrows.

25. A food packaging cover comprising an elevated top section, a depending wall section and a shoulder section interconnecting the top and wall sections, said wall section being formed from vertical furrows having inwardly projecting ribs, said shoulder section including a plurality of symmetrically arranged outwardly pointed triangular shaped flats having one edge disposed along the perimeter of said top section and gusset means extending between and interconnecting the adjacent edges of adjacent flats to form an inwardly converging furrow in substantial endwise alignment with each of said vertical furrows for substantially uniformly distributing a load placed on said top section to said wall section.

26. The food packaging cover of claim 25 wherein said vertical furrows comprise alternately repeating first and second vertical furrows.

* * * * *